US008511018B2

(12) United States Patent
Lawrie et al.

(10) Patent No.: US 8,511,018 B2
(45) Date of Patent: Aug. 20, 2013

(54) VINYL SIDING OUTSIDE CORNER MOUNTING BLOCK

(76) Inventors: James Robert Lawrie, Spencer, WI (US); Jeanne Elaine Lawrie, Spencer, WI (US)

( * ) Notice: Subject to any disclaimer, the term of this patent is extended or adjusted under 35 U.S.C. 154(b) by 625 days.

(21) Appl. No.: 11/293,755

(22) Filed: Dec. 5, 2005

(65) Prior Publication Data

US 2007/0125029 A1 Jun. 7, 2007

(51) Int. Cl.
*E04B 2/00* (2006.01)

(52) U.S. Cl.
USPC ..... 52/288.1; 52/282.1; 52/287.1; 52/280

(58) Field of Classification Search
USPC ..... 52/287.1, 288.1, 282.1, 631, 282.4, 52/282.3, 280, 767, 465, 466, 469, 470, 312, 52/459, 716.1, 718.01, 58, 255, 717.04; 403/205
See application file for complete search history.

(56) References Cited

U.S. PATENT DOCUMENTS 855,195 A * 5/1907 Marr ..... 52/463
2,079,635 A * 5/1937 Sharp ..... 52/241
2,373,789 A * 4/1945 Smith ..... 52/282.3
3,302,350 A * 2/1967 Brown et al. ..... 52/288.1
3,525,188 A * 8/1970 Torbett ..... 52/288.1
3,742,668 A * 7/1973 Oliver ..... 52/288.1
4,104,839 A * 8/1978 Balzer et al. ..... 52/288.1
4,127,974 A * 12/1978 Wendt ..... 52/287.1
4,258,519 A * 3/1981 Hugens ..... 52/282.1
4,319,439 A * 3/1982 Gussow ..... 52/288.1
4,731,973 A * 3/1988 Stenemann ..... 52/767
4,999,961 A * 3/1991 McNary ..... 52/287.1
5,138,810 A * 8/1992 Kartler ..... 52/254
5,226,755 A * 7/1993 Tweedt ..... 403/205
5,283,997 A * 2/1994 Lackie ..... 52/287.1
5,345,737 A * 9/1994 Latchinian ..... 52/280
5,363,617 A * 11/1994 Miller ..... 52/288.1
5,516,225 A * 5/1996 Kvols ..... 403/170
5,664,376 A * 9/1997 Wilson et al. ..... 52/287.1
5,927,031 A * 7/1999 Martin ..... 52/288.1
5,974,748 A * 11/1999 Sciuga et al. ..... 52/287.1
6,041,555 A * 3/2000 Alpi ..... 52/11
6,122,874 A * 9/2000 Smerilli ..... 52/408
6,205,738 B1 * 3/2001 Chen ..... 52/653.2
6,311,442 B1 * 11/2001 Watanabe ..... 52/282.3
6,631,600 B2 * 10/2003 Schiedegger et al. ..... 52/658
6,681,530 B1 * 1/2004 Givens ..... 52/58
7,290,379 B2 * 11/2007 Allen ..... 52/745.19
8,061,105 B2 * 11/2011 Haga ..... 52/631
2005/0246986 A1 * 11/2005 Dugger ..... 52/287.1

* cited by examiner

*Primary Examiner* — Chi Q Nguyen
(74) *Attorney, Agent, or Firm* — Derek L. Prestin

(57) ABSTRACT

The Vinyl Siding Outside Corner Mounting Block, made of molded plastic, nailed approximately two feet apart to the outside verticle corner of a structure with one 8d box nail, makes the application of the vinyl siding outside corners simple, fast and accurate.

8 Claims, 2 Drawing Sheets

VINYL SIDING OUTSIDE CORNER MOUNTING BLOCK

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The Vinyl siding outside corner mounting block is used in the field of construction, both residential and commercial, with the application of vinyl siding to the exterior of a building.

BRIEF SUMMARY OF THE INVENTION

It is a feature of the present invention to provide an outside corner mounting block for use with siding which allows the siding outside corner and outside corner mounting block to be easily and quickly mounted to a structure.

More specifically, the present invention provides an outside corner mounting block that comprises a molded plastic body having an angled configuration. The molded plastic body forms an angle that matches the angle of the outside corner of the structure to which it is to be attached, and includes an integral mounting support that allows the molded plastic body to be quickly and easily secured to the corner of the structure. The integral mounting support includes an aperture that is sized to allow a fastener, such as a nail, screw, or other similar fastener, to be received therein to attach the outside corner mounting block to the structure. As such, the present invention may be quickly and easily attached to the structure using standard fasteners.

According to a still further broad aspect of the present invention there is provided a method of securing standard siding outside corners, such as vinyl siding outside corners, to the outside corner mounting block without the use of fasteners or adhesives to hold the siding outside corner in position while it is permanently attached to the structure by the installer. The method comprises snapping the outside corners over the outside corner mounting block, which then holds the outside corner secure to the structure, while allowing the outside corner to be shifted vertically into its final position and then permanently attached to the structure.

When utilizing the present invention to mount vinyl siding outside corners to a structure, the outside corner mounting blocks of the present invention are nailed to the vertical outside corners of the structure approximately two feet apart before mounting the vinyl siding outside corners. The vinyl siding outside corners are then snapped into place over the outside corner mounting blocks, and the vinyl siding outside corners are then aligned and nailed to the structure.

The advantages of the present invention are that the outside corner mounting blocks allow for the proper straight, square, and plumb alignment of the siding outside corners, eliminating the need for separately measuring, snapping chalk lines, and maintaining the alignment of the outside corners while securing the outside corners to the structure. The outside corner mounting blocks of the present invention are easy to use, guaranty accuracy, and allow installers to save time when mounting the outside corners.

Additionally, when the outside corner mounting block is used on the very top or bottom of the outside corner, the outside corner mounting block fully blocks the gap between the outside corner of the structure and the siding outside corner, thereby preventing mice, rats, and other vermin from crawling between the outside corner and the siding outside corner and gaining entry into the structure.

DETAILED DESCRIPTION OF THE INVENTION

Figure 1:
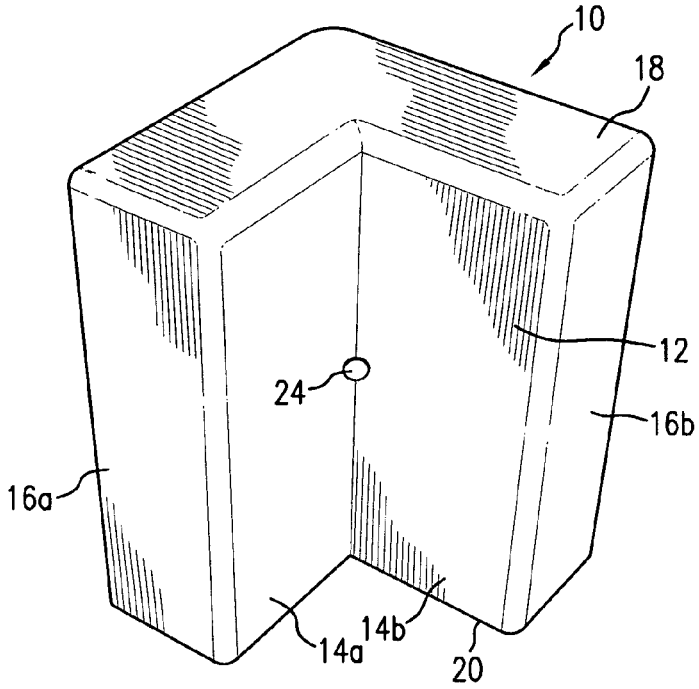
FIG. 1 is a perspective view of a outside corner mounting block embodying features of the present invention.
Figure 2:
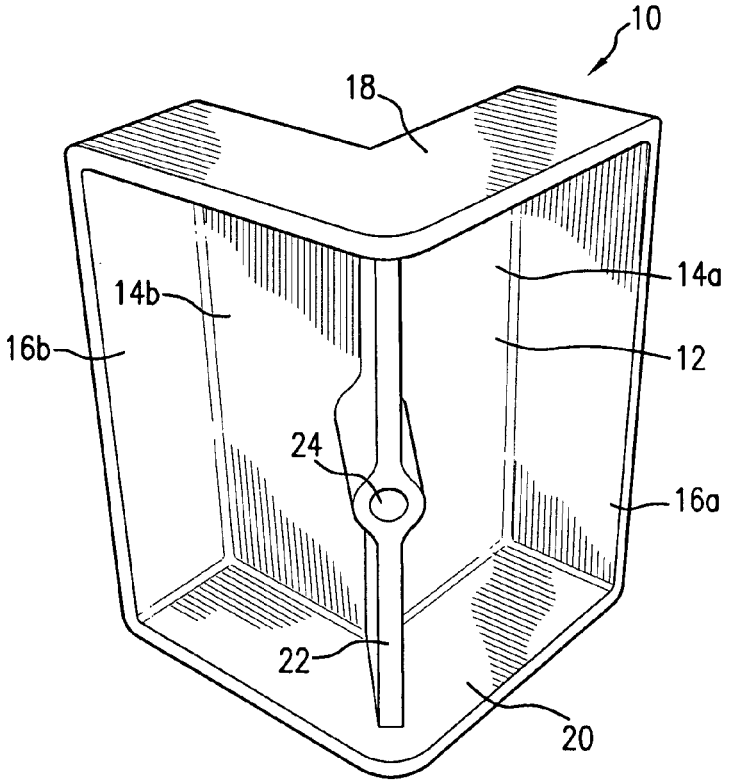
FIG. 2 is an alternative perspective view of the outside corner mounting block of FIG. 1.

As shown in FIGS. 1-4, the outside corner mounting block 10 of the present invention comprises a body 12 having an angled configuration that matches the angle of the outside corner to which it is to be attached. Preferably, for a standard 90-degree outside corner, the outside corner mounting block 10 has an L-shaped configuration, with an angle of approximately ninety (90) degrees between the two sides of the L. The body 12 of the outside corner mounting block 10 is generally constructed of injection molded plastic.

The body 12 includes two inner walls 14*a*, 14*b*, two side walls 16*a*, 16*b*, a top sealing wall 18, a bottom sealing wall 20, and an integral mounting support 22. The two inner walls 14*a*, 14*b* are adjacent to each other and meet at an angle that matches the angle of the outside corner to which the outside corner mounting block 10 is to be attached. Preferably, for a standard 90-degree outside corner, the inner walls 14*a*, 14*b* meet at an angle of ninety (90) degrees. However, if the outside corner has an angle that is different than ninety (90) degrees, the inner walls 14*a*, 14*b* of the body 12 may be configured to match such an angle.

Each of the two side walls 16*a*, 16*b* of the body 12 are adjacent to one of the inner walls 14*a*, 14*b* of the body 12. The side walls 16*a*, 16*b* are configured to provide additional strength and rigidity to the outside corner mounting block 10 and to separate and support the top sealing wall 18 and the bottom sealing wall 20. The side walls 16*a*, 16*b* also provide a surface onto which the siding outside corner 100 may be snapped onto the outside corner mounting block 10. The dimensions of the side walls 16*a*, 16*b* are selected such that the edges of the siding outside corner 16*a*, 16*b* are held flush against the wall 102 of the structure 104 to which the siding outside corner 100 is to be attached when the siding outside corner 100 is attached to the outside corner mounting block 10.

The body 12 also includes an integral mounting support 22 that allows the body 12 to be secured to the corner of the structure 104. Preferably, the integral mounting support 22 is immediately adjacent to the portion of the body 12 where the two inner walls 14*a*, 14*b* meet. The integral mounting support 22 includes an aperture 24 for attaching the outside corner mounting block 10 to the wall 102 of the structure 104 to which the outside corner mounting block 10 is to be attached, and also provides the body 12 of the outside corner mounting block 10 with additional strength and rigidity. More specifically, the integral mounting support 22 provides the top sealing wall 18 and the bottom sealing wall 20 with additional support, such that the top sealing wall 18 and the bottom sealing wall 20 are substantially prevented from flexing.

The aperture 24 defined by the integral mounting support 22 is sized to allow a fastener 26, such as a nail, screw, or other similar fastener, to be received therein in order to secure the outside corner mounting block 10 to the structure 104. As such, the outside corner mounting block 10 of the present invention may be quickly and easily attached to the structure 104 using standard fasteners.

The dimensions for the body 12 of the outside corner mounting block 10 may be selected such that that outside corner mounting block 10 may be used with any siding known in the art. For example, preferably, for standard vinyl siding outside corners, the outside corner mounting block may have a height of approximately three (3) inches, a width of approximately two (2) inches, and a thickness of approximately one (1) inch.

The outside corner mounting block 10 of the present invention may be used in conjunction with the application of vinyl siding, and other similar siding, to both residential and commercial structures.

Figure 3:
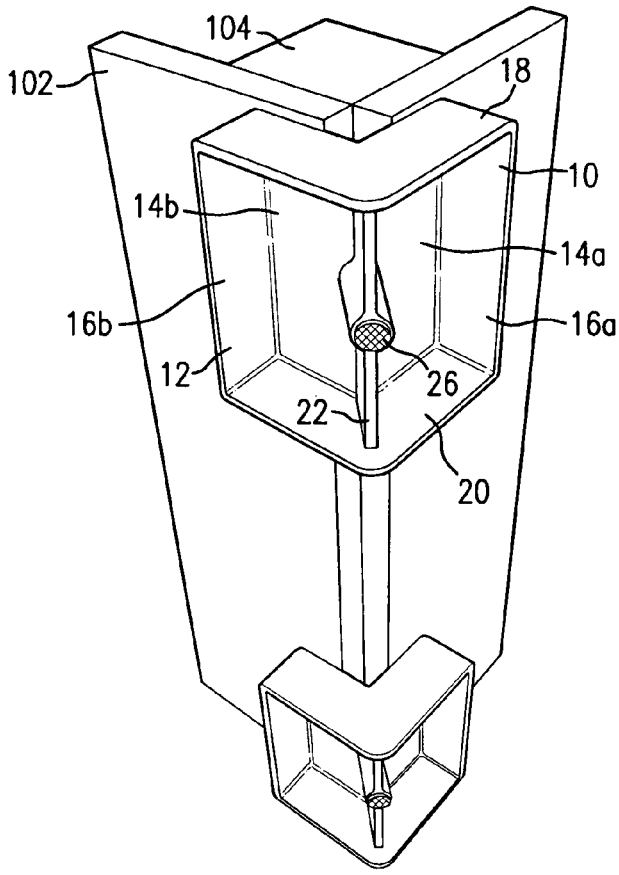
FIG. 3 is a perspective view of the outside corner mounting block of FIG. 1 attached to a corner of a structure.
Figure 4:
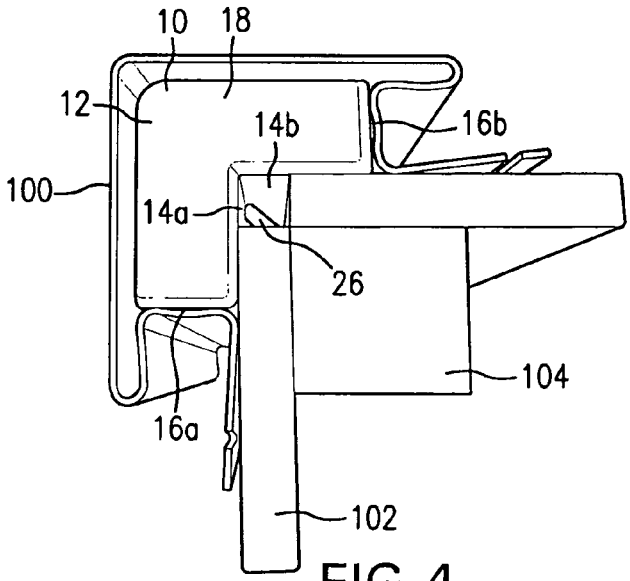
FIG. 4 is a plan view of the outside corner mounting block of FIG. 1 attached to a corner of a structure showing the siding outside corner secured to the outside corner mounting block.

As best seen in FIGS. 3 and 4, in order to use the present invention, a plurality of the outside corner mounting blocks 10 are secured to the outside corner of the structure 104 approximately two (2) feet apart with the fastener 26, such as a nail, screw, or similar fastener, before any other siding is applied to the adjacent walls 102 of the structure 104. The siding outside corner 100 may then be snapped into place over the outside corner mounting blocks 10 and secured to the structure 104 with standard siding fasteners, such as a nails, screws, or similar fasteners. Once the siding outside corner 100 has been secured to the structure 104, the siding may be applied to the walls of the structure 104.

The outside corner mounting block 10 of the present invention may be produced by a factory in the plastic molding business in any way generally known in the art. Preferably, the outside corner mounting block 10 may be mass produced using molds and any injection-type plastic known in the art by injecting the injection-type plastic into the mold. The outside corner mounting block 10 may then be distributed through building material suppliers or siding suppliers.

It will be recognized by one skilled in the art that the size, configuration, or dimensions of the outside corner mounting block may be adjusted to accommodate siding from different manufacturers, or to accommodate outside corners having different predetermined angles.

While the invention has been described in the specification and illustrated in the drawings with reference to certain preferred embodiments, it will be understood by those skilled in the art that various changes may be made and equivalents may be substituted for elements thereof without departing from the scope of the present invention as defined in the appended claims. In addition, many modifications may be made to adapt a particular situation or material to the teachings of the invention, as defined in the appended claims, without departing from the essential scope thereof. Therefore, it is intended that the present invention not be limited to the particular embodiments illustrated by the drawings and described in the specification as the best modes presently contemplated for carrying out the present invention, but that the present invention will include any embodiments falling within the description of the appended claims.

The invention claimed is:

1. An outside corner mounting block comprising:

a body;

wherein the body includes a mounting support that is integral to the body;

wherein the body includes at least two inner walls that are configured to have an angle that matches the angle of an outside corner of a structure, wherein the outside corner of the structure is received by the angle made by said at least two inner walls such that the inner walls abut the outer surface of the outside corner of the structure, wherein the mounting support of the body defines at least one aperture for receiving at least one fastener for securing the outside corner mounting block to the structure, wherein the body includes at least two side walls with each side wall being adjacent and contiguous to an edge of an inner wall, wherein the body includes at least two sealing walls that are integral to the body, wherein the inner walls, the side walls, and the sealing walls define and surround a hollow space adjacent to the inner walls, the side walls, and the sealing walls, wherein the mounting support extends across the hollow space defined and surrounded by the inner walls, the side walls, and the sealing walls, and wherein the outside corner mounting block has a one-piece configuration and is a one-piece component.

2. The outside corner mounting block of claim 1, wherein the body is plastic.

3. The outside corner mounting block of claim 2, wherein the plastic is an injection molded plastic.

4. The outside corner mounting block of claim 1, wherein the body has an L-shaped configuration and wherein the outside corner has an angle of ninety degrees.

5. The outside corner mounting block of claim 1, wherein the mounting support defines a plurality of apertures for receiving a plurality of fasteners for securing the outside corner mounting block to the structure.

6. The outside corner mounting block of claim 1, further comprising at least one fastener.

7. The outside corner mounting block of claim 6, wherein the at least one fastener is a nail.

8. The outside corner mounting block of claim 6, wherein the at least one fastener is a screw.

* * * * *